US012560393B2

(12) United States Patent
Collard et al.

(10) Patent No.: US 12,560,393 B2
(45) Date of Patent: Feb. 24, 2026

(54) ASSEMBLY FOR POSITIONING AND KEEPING IN POSITION A PROJECTILE IN A STRETCHER AND LOADING-AID DEVICE COMPRISING SUCH AN ASSEMBLY

(71) Applicant: KNDS FRANCE, Versailles (FR)

(72) Inventors: Maxime Collard, Bourges (FR); Ludovic Dupont, Bourges (FR)

(73) Assignee: KNDS FRANCE, Versailles (FR)

( * ) Notice: Subject to any disclaimer, the term of this patent is extended or adjusted under 35 U.S.C. 154(b) by 0 days.

(21) Appl. No.: 19/006,502

(22) Filed: Dec. 31, 2024

(65) Prior Publication Data

US 2025/0251205 A1 Aug. 7, 2025

(30) Foreign Application Priority Data

Jan. 2, 2024 (FR) ..... 2315191

(51) Int. Cl.
*F41A 9/42* (2006.01)

(52) U.S. Cl.
CPC ..... *F41A 9/42* (2013.01)

(58) Field of Classification Search
CPC ..... F41A 9/39–43; F41A 9/09; F41A 9/13; F41A 9/16
USPC ..... 89/45–47
See application file for complete search history.

(56) References Cited

U.S. PATENT DOCUMENTS

| | | | | |
|---|---|---|---|---|
| 4,318,331 | A | 3/1982 | Echtler et al. | |
| 5,563,363 | A | 10/1996 | Soulaigre et al. | |
| 6,457,397 | B1 | 10/2002 | Guesnet et al. | |
| 10,619,957 | B2 * | 4/2020 | Hasler | F41A 9/21 |
| 2002/0029687 | A1 * | 3/2002 | Heldmann | F42B 39/22 89/46 |
| 2024/0219137 | A1 * | 7/2024 | Stolz | F41A 9/83 |
| 2025/0207878 | A1 * | 6/2025 | Hummel | F41A 9/60 |
| 2025/0251205 | A1 * | 8/2025 | Collard | F42B 39/22 |

FOREIGN PATENT DOCUMENTS

| | | | |
|---|---|---|---|
| DE | 10 2021 117951 | A1 | 1/2023 |
| EP | 0 022 286 | A1 | 1/1981 |
| EP | 0 058 814 | A2 | 9/1982 |
| EP | 4 214 458 | B1 | 9/2024 |
| FR | 2 721 387 | A1 | 12/1995 |
| FR | 2 796 713 | A1 | 1/2001 |
| FR | 3 043 190 | A1 | 5/2017 |
| FR | 3 054 656 | A1 | 2/2018 |
| FR | 3 114 384 | A1 | 3/2022 |
| GB | 1 492 815 | A | 11/1977 |

OTHER PUBLICATIONS

Jul. 10, 2024 Search Report and Written Opinion issued in French Patent Application No. 2315191.

* cited by examiner

*Primary Examiner* — John Cooper
(74) *Attorney, Agent, or Firm* — Oliff PLC

(57) ABSTRACT

The invention relates to a rammer (1) for positioning an artillery shell, the rammer (1) comprising a stretcher (2) intended to receive the shell and guide it in translation, the rammer (1) being characterized in that it comprises a pusher (4) which can be driven in a reciprocating movement along the stretcher (2), reciprocating movement which is provided by a pair of closed flexible links (6) arranged on either side of the pusher (4), each link (6) connecting a drive wheel (6*b*) and a free wheel (6*a*), the pusher (4) having a bearing surface intended to correspond with a rear face of the shell in order to push it.

12 Claims, 7 Drawing Sheets

[Fig. 1]
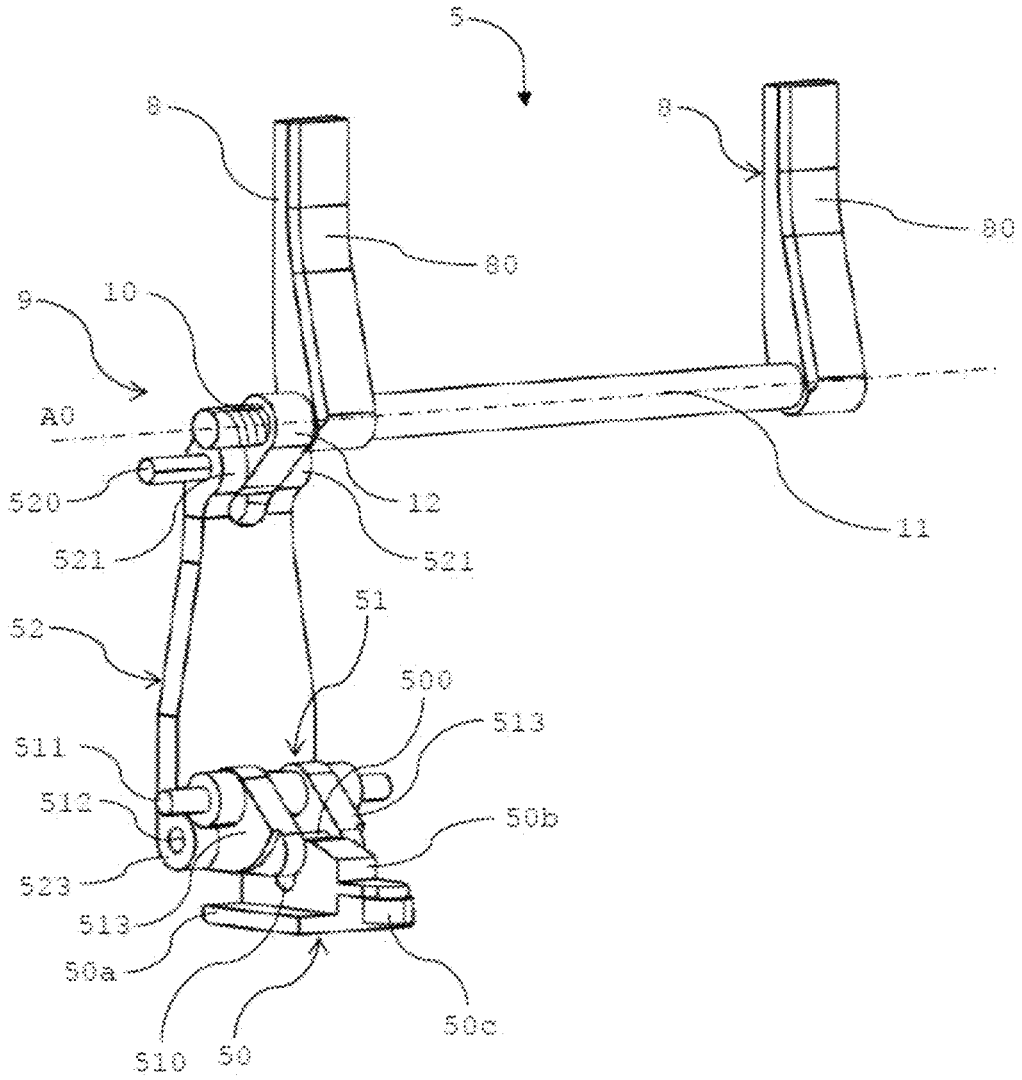

[Fig. 2]
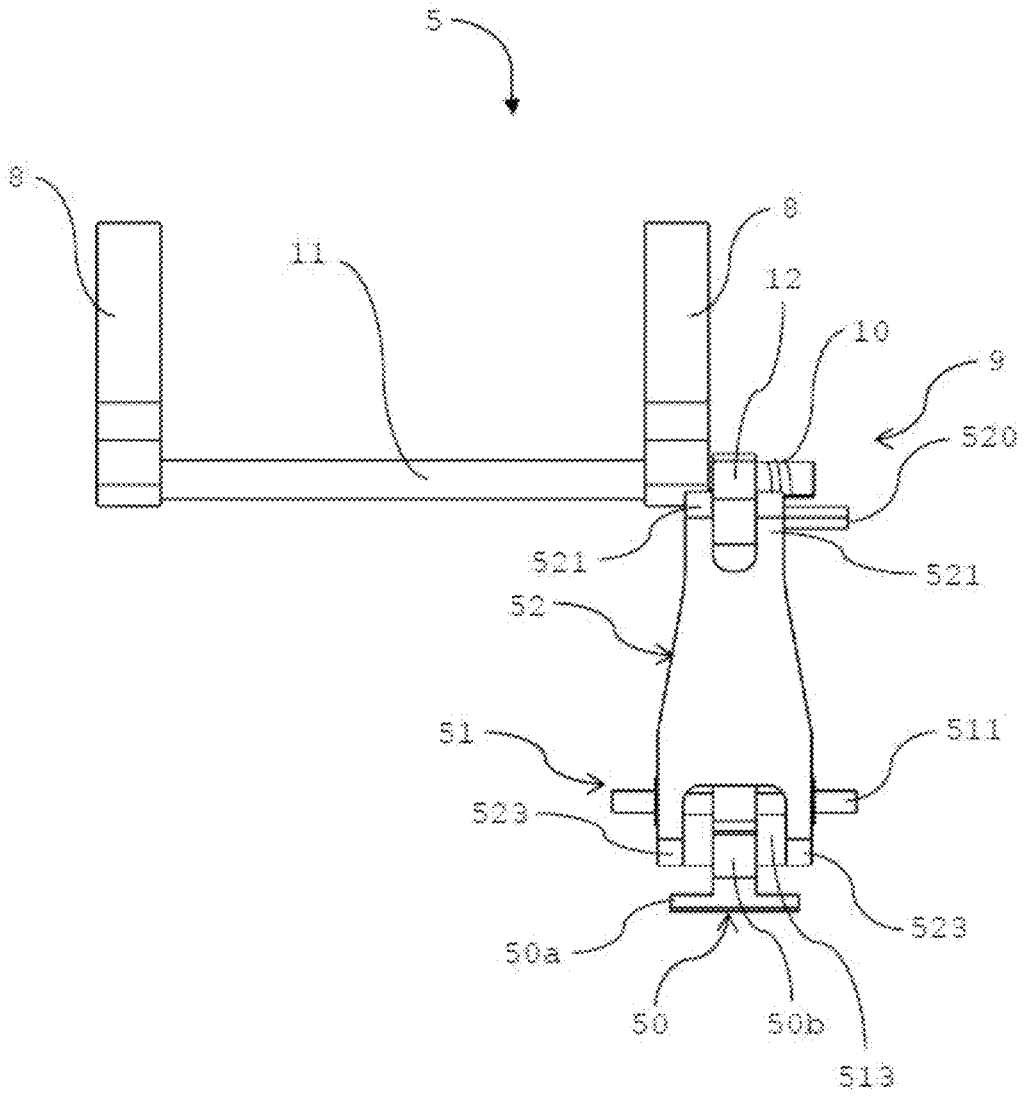

[Fig. 3]
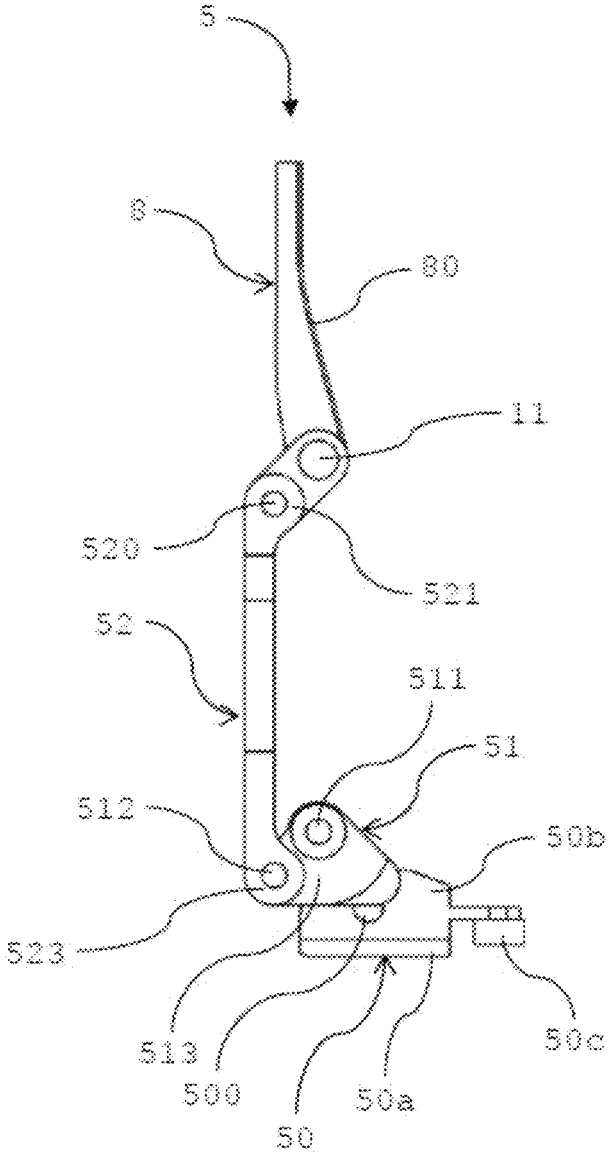

[Fig. 4]
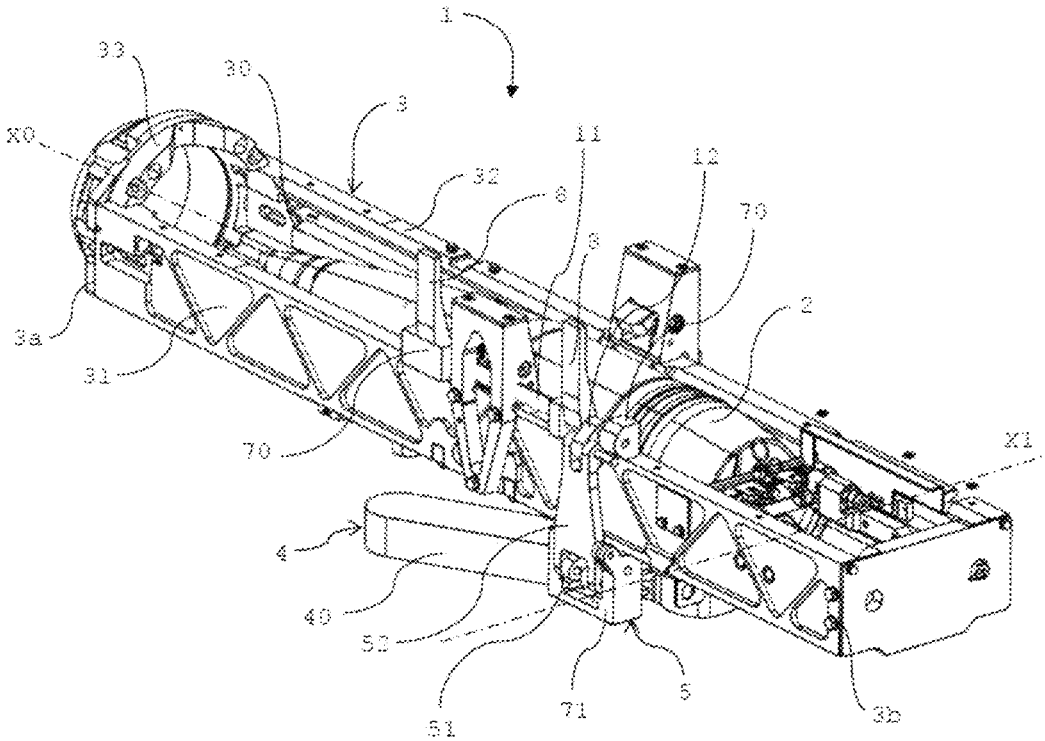

[Fig. 5]
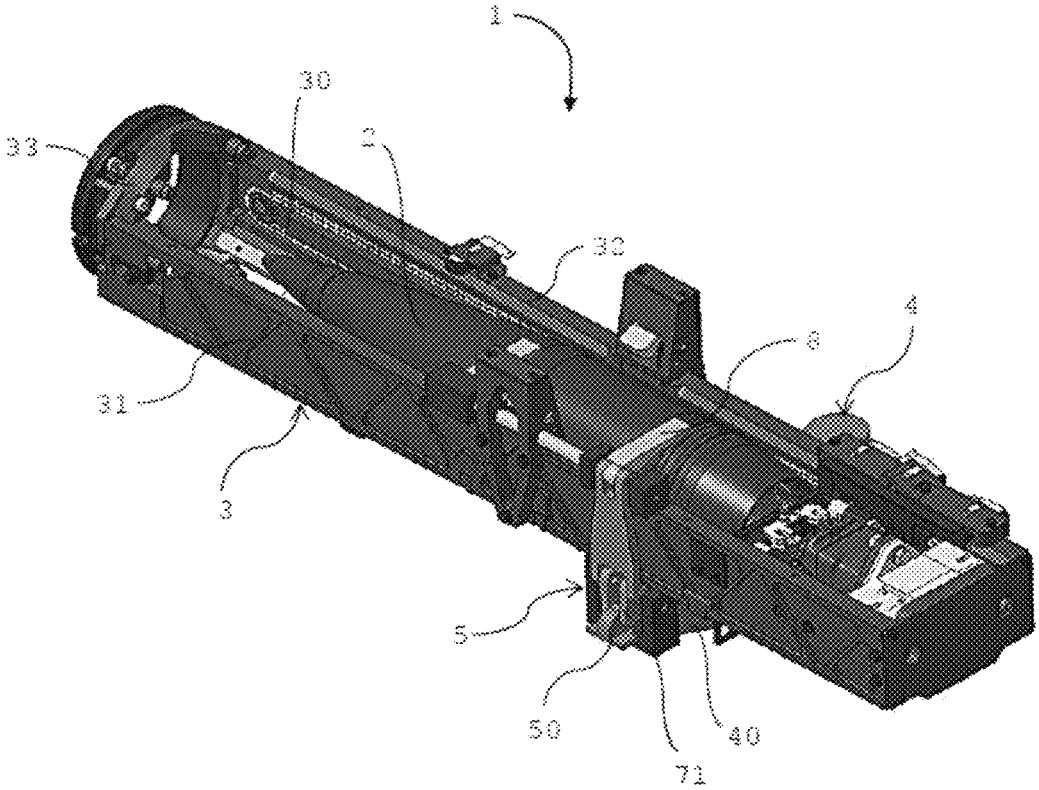
[Fig. 6]
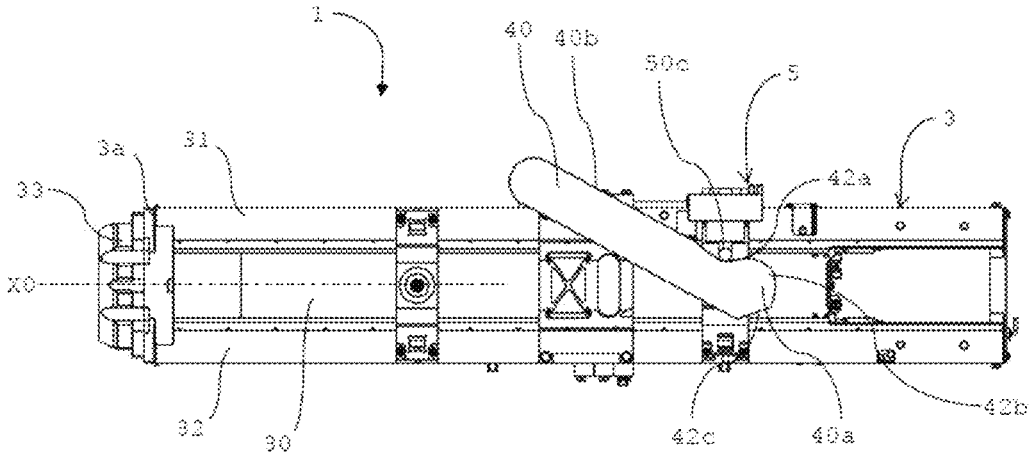

[Fig. 7]
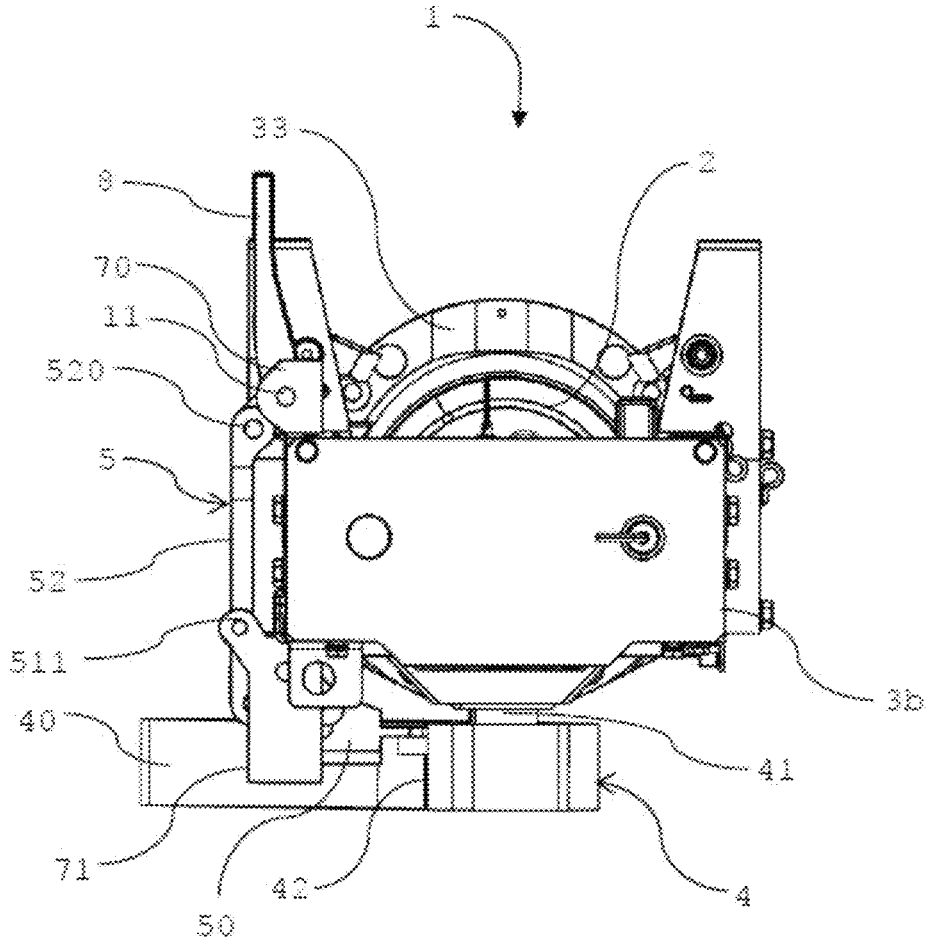

[Fig. 8]
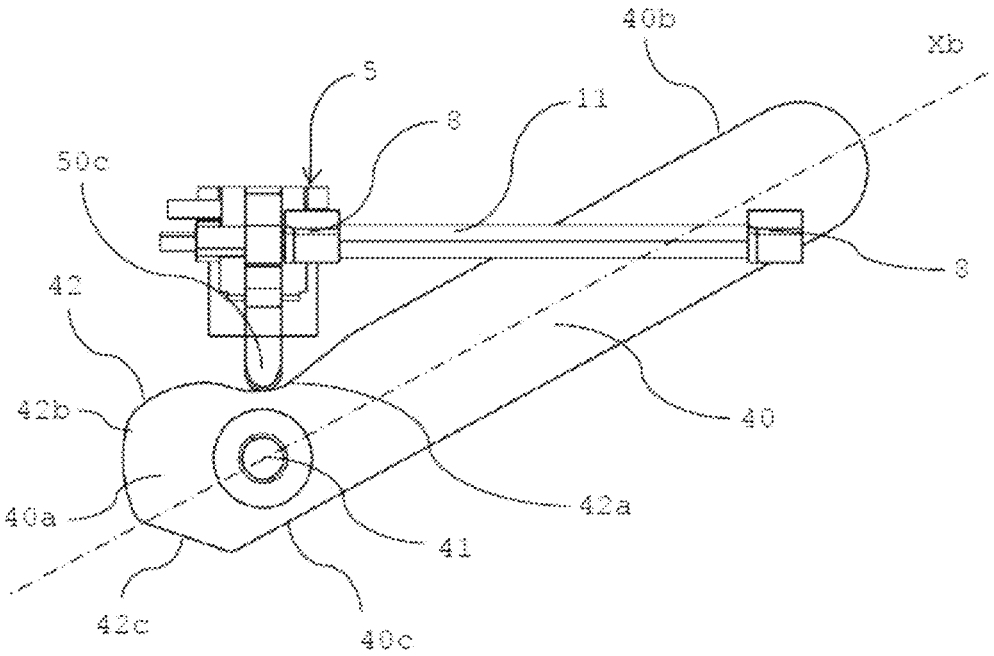

ASSEMBLY FOR POSITIONING AND KEEPING IN POSITION A PROJECTILE IN A STRETCHER AND LOADING-AID DEVICE COMPRISING SUCH AN ASSEMBLY

The technical field of the invention is that of devices for the loading of a projectile into the chamber of a large caliber weapon, and more particularly, devices comprising a stretcher which is intended to receive the projectile and which can be moved in order to get closer to the chamber of the weapon and to serve for the ramming of the projectile.

To feed a large caliber weapon, it is well known to use a stretcher intended to receive the projectile.

For example, French patent FR3114384 describes a device for loading a shell into the chamber of a weapon comprising a stretcher mounted slidably on a stretcher support which is as such connected to the weapon by a set of connecting rods the pivoting of which with respect to the weapon leads to the displacement of the stretcher.

French patent FR3043190 describes more particularly such a stretcher, which stretcher is equipped with a rammer intended to bear against the base of a shell received in the stretcher and to exert a thrust on the shell for the ramming thereof.

French Patent FR2721387 also describes a shell-receiver stretcher which is brought by rotation, more particularly by means of a rotary cylinder with a helical piston, into the axis of the barrel chamber. The stretcher has the advantage of being provided with an anti-extraction device which is intended to prevent the ejection of the shell during the rotation of the stretcher.

French Patent FR2796713 further discloses a stretcher provided with a device to prevent the ejection of the shell during the displacement of the stretcher. More particularly, the patent describes a stretcher carrying a chain rammer supporting a locking means for automatically locking the shell when same is set in place on the stretcher. The locking means has the shape of an eccentric cam that allows the shell to be placed in the stretcher but prevents the shell, by over-center locking, from being radially withdrawn.

The anti-extraction device of the patent FR2721387, as well as the locking means of the patent FR2796713, although effective in preventing the ejection of the shell during the displacement of the stretcher, do not serve for positioning and keeping in position the shell in the stretcher, more particularly for the alignment of the shell with the longitudinal axis of the stretcher.

However, the alignment of the shell with the longitudinal axis of the stretcher, and thus with the longitudinal axis of the barrel in which the shell is to be positioned, is necessary to ensure that the shell is correctly placed in the weapon chamber. Indeed, in the case where the shell is not perfectly aligned with the longitudinal axis of the stretcher, the risk involved is that the shell is misplaced in the chamber of the weapon, which generates safety problems. For example, in the case where the shell is placed crosswise in the weapon chamber, the shell may arrive at the level of the forcing cone with reduced speed and may not be properly hooked to the forcing cone and hence may become detached.

The present invention thus aims to provide a solution for not only preventing the ejection of the shell during the displacement of the stretcher, but also for improving the positioning and the keeping in position of the shell in the stretcher and hence for ensuring a perfect alignment of the shell with the chamber of the weapon during the ramming of the shell.

The solution according to the present invention is based on the arrangement of at least one arm movable between a raised position permitting the placement of the projectile in the stretcher and a lowered position allowing the projectile to be correctly positioned in the stretcher and to be maintained in the correct position before the projectile is pushed toward the front of the stretcher, in particular to place and keep same in position at the bottom of t stretcher and in alignment with the longitudinal axis of the stretcher.

The present invention thus relates to a positioning and position keeping assembly for positioning and keeping in position a projectile, such as a shell, in a stretcher having a longitudinal axis, the stretcher being movable between a first position called placement position for the projectile and a second position called ramming position for the projectile, using drive means which are movable, the positioning and position keeping assembly being characterized in that it comprises:

- at least one movable arm including a bearing surface, the at least one arm being intended to be mounted so as to be pivotable about a pivot axis orthogonal to the longitudinal direction of the at least one arm and, in use, parallel to the longitudinal axis of the stretcher, between a raised position permitting the placement of the projectile in the stretcher, and a lowered position wherein the bearing surface is able to cooperate with the projectile received in the stretcher so as to ensure the alignment of the projectile with the longitudinal axis of the stretcher,
- a pivoting actuation mechanism intended to cooperate with the drive means and arranged to convert a movement of the drive means during the displacement of the stretcher from the placement position to the ramming position into a pivoting of the at least one arm from the raised position to the lowered position, and
- elastic return means for the at least one arm so as to return same to the raised position thereof once the stretcher has been placed in the ramming position.

Such an assembly, applied to a projectile loading stretcher, and arranged and configured to allow the projectile to be placed in the stretcher, serves not only to prevent the radial withdrawal of the projectile before same is rammed, but also to guarantee the alignment of the longitudinal axis of the projectile with the longitudinal axis of the stretcher and hence with the longitudinal axis of the barrel wherein the projectile is intended to be rammed. Thereby, the assembly according to the present invention, makes it possible to improve safety by positioning and keeping the projectile in the correct position in the stretcher.

Preferably, the bearing surface has a concave longitudinal profile. Such a profile is particularly suitable for a projectile comprising a body having a cylindrical portion and a conical portion.

Preferably, the assembly includes a pair of arms connected together by an actuating rod having a longitudinal axis which in use is coaxial with the pivot axis, the actuating rod being secured to the pivoting actuation mechanism and movable in rotation about the pivot axis, the two arms being spaced from each other along said actuating rod. The arrangement of two arms provides a better support and hence a better positioning of the projectile against the bottom of the stretcher, without, however, excessively increasing the weight of the assembly.

Advantageously, the actuating rod is a torsion bar. Such a torsion bar serves to take into account variable geometries of the projectiles by allowing the arms to have a difference in angular positioning with respect to each other in the lowered position.

Preferably, the elastic return means are formed by a return spring, in particular a spiral torsion spring mounted coaxially about the pivot axis or parallel to said pivot axis. Such a return spring is a simple and inexpensive return means for returning to the raised position the at least one arm in the absence of any rotational movement of the stretcher, which return to the raised position allows, in use, the ramming of the placed projectile as well as the placement of a new projectile.

According to a particular embodiment, the pivoting actuation mechanism comprises:

- a pusher intended to cooperate with the drive means and mounted to be slidable along a sliding axis orthogonal to the pivot axis,
- a rocker articulated to the pusher and mounted to be pivotable about an axis orthogonal to the sliding axis of the pusher and parallel to the pivot axis of the at least one arm,
- a copy-back connecting rod articulated, by two pivot connections the axes of which are parallel, between the rocker and an actuating member, and
- said actuating member, which is mounted to be pivotable about the pivot axis of the at least one arm and is rotationally secured to the at least one arm, where applicable, to the actuating rod, the pivoting actuation mechanism being arranged in such a way that a translation of the pusher, under the action of the movement of the drive means, causes a pivoting of the rocker, which in turn causes a displacement of the copy-back connecting rod which makes the actuation member and hence the at least one arm pivot about the pivot axis.

Such a mechanism has the advantage of being reliable and having a small number of pieces.

Advantageously, the pivoting actuation mechanism is configured such that the pivoting angle of the at least one movable arm is about 90 degrees.

The present invention also relates to a loading-aid device for loading a projectile, such as a shell, into the chamber of a weapon, which device includes a stretcher for receiving the projectile and drive means for driving the stretcher and able to move the stretcher between a first position called placement position for the projectile and a second position called ramming position for the projectile, characterized in that the device further includes a positioning and position keeping assembly as defined hereinabove, which is secured to the stretcher and is arranged on a lateral side of the stretcher with the pivot axis of at the at least one arm parallel to the longitudinal axis of the stretcher.

Thereby, the control of the pivoting actuation mechanism by the drive means of the stretcher serves for placing the positioning and position keeping assembly in the lowered position thereof, wherein the projectile is pressed against the bottom of the stretcher, during the displacement of the stretcher from the placement position to the ramming position, and to allow same to return to the raised position thereof when arriving at the ramming position and in the absence of said displacement of the stretcher, to allow, in the placement position, placing a projectile in the stretcher, and, in the ramming position, the ramming of a placed projectile.

Preferably, the pivot axis of the at least one arm is positioned above and in the vicinity of the upper edge of the lateral side of the stretcher, in the plane of said lateral side.

In a particular embodiment, the drive means comprise a set of connecting rods intended to be articulated between the weapon and the stretcher about an articulation axis orthogonal to the pivot axis of the at least one arm, one of the connecting rods of the set of connecting rods comprising a receiving means for receiving the rotational movement of the connecting rod and able to cooperate with the pivoting actuation mechanism of the at least one arm.

Preferably, the receiving means is a cam track formed on the connecting rod.

Preferably, the receiving means is formed on a rear connecting rod of the set of connecting rods, the pivoting actuation mechanism being positioned in the vicinity of the rear end of a projectile placement zone of the stretcher.

In order to better illustrate the subject matter of the present invention, a particular embodiment thereof will be described hereinafter, with reference to the enclosed drawings. On these drawings:

FIG. 1 is a perspective view of the positioning and position keeping assembly according to the present invention;

FIG. 2 is a longitudinal side view of the assembly shown in FIG. 1;

FIG. 3 is a transverse side view of the assembly shown in FIG. 1;

FIG. 4 is a rear three-quarter perspective view of the loading-aid device according to the present invention, with a projectile placed in the stretcher and the positioning and position keeping assembly shown in FIG. 1 in the raised position;

FIG. 5 is a view similar to the view of FIG. 4, the positioning and position keeping assembly shown in FIG. 1 being in the lowered position;

FIG. 6 is a top view of the device shown in FIG. 4;

FIG. 7 is a rear view of the device shown in FIG. 4; and

FIG. 8 is a detailed top view showing the cooperation between the positioning and position keeping assembly and the rear connecting rod of the means for driving in rotation the stretcher.

Referring first of all to FIGS. 4 to 7, it can be seen that the loading-aid device 1 for loading a projectile 2 into the chamber of a weapon according to the present invention comprises, in a known manner, a stretcher 3 and drive means 4 for the stretcher 3. The loading-aid device 1 according to the present invention further comprises a positioning and position keeping assembly 5, hereinafter referred to more simply as "assembly 5", for positioning and keeping in position the projectile 2 in the stretcher 3, more particularly for pressing the projectile 2 against the bottom of the stretcher 3, in a pressed position in which the longitudinal axis of the projectile 2 is coaxial with the longitudinal axis X0 of the stretcher 3, during the displacement of the stretcher 3.

The stretcher 3, as shown in FIGS. 4 to 7, is a well-known stretcher 3 described e.g. by the French patent FR3043190. The stretcher 3 includes a trough 30 substantially in the form of a semicylindrical rectilinear profile able to receive a projectile 2 which can be placed in the stretcher 3 from above using a means of placement (not shown), e.g. a clamp. The concave open surface of the trough 30 defines the placement zone for the projectile 2. The diameter of the placement zone is slightly greater than the diameter of the projectile 2. Lateral beams 31, 32 extend on both sides of the trough 30, along the longitudinal direction of the trough 30, facing each other. Thereby, a projectile 2, such as a shell, placed in the stretcher 3 is positioned on the trough 30 and between the lateral beams 31, 32. The front end 3*a* of the stretcher 3 has a positioning ring 33 intended to interface the stretcher 3 with the inlet of the chamber of a weapon (weapon not shown). At the rear end 3*b* of the stretcher 3 there is a rammer 6 able to be moved in translation along the stretcher 3 in order to push the projectile 2 received on the trough 30 toward the chamber of the weapon.

The drive means 4 serve to move the stretcher 3 from a first position, called placement position for the projectile 2, to a second position, called ramming position for the projectile 2.

The drive means 4 for the stretcher 3, partially represented in FIGS. 4 to 8, are well-known means described, e.g., by the French patent FR3114384. The means 4 comprise connecting rods, including a front carrying connecting rod and a rear carrying connecting rod 40, connected both to the stretcher 3 and to the weapon, and the pivoting of which with respect to the weapon leads to the displacement of the stretcher 3 between the placement position and the ramming position. In the particular embodiment shown, it is the rear carrying connecting rod 40, shown in FIGS. 4 to 8, which is intended to cooperate with the pivoting actuation mechanism of the positioning and position keeping assembly 5. The connecting rod 40 carries, at its first end 40*a*, connected to the stretcher 3, a vertical articulation shaft 41 housed in a bore provided on the convex lower face of the trough 30 of the stretcher 3.

As can be seen more particularly in FIGS. 6 and 8, the connecting rod 40 further carries, at its first end 40*a*, the receiving means 42 for receiving the rotational movement of the connecting rod 40.

In the particular embodiment shown, the receiving means 42 is a cam track formed on the lever 40. The cam track is herein defined by the lateral flank of the first end 40*a* of the lever 40. The cam track comprises a concave zone 42*a* with the general shape of a V, arranged on a first longitudinal side 40*b* of the connecting rod 40, on the side of the positioning and position keeping assembly 5, at the articulation shaft 41. The concave zone 42*a* is rounded so as to ensure a transmission of the rotational movement without any risk of jamming. The concave zone 42*a* is followed by a rounded bulge zone 42*b*, at which the width of the connecting rod 40 increases, then by a flat 42*c* which starts overall from the longitudinal axis Xb of the connecting rod 40 to join the second longitudinal side 40*c* of the connecting rod 40. The flat 42*c* is inclined with respect to the longitudinal axis Xb.

The assembly 5 according to the present invention is connected to the stretcher 3 and is arranged on a lateral side of the stretcher 3, more particularly on the lateral side of the stretcher 3 toward which the cam track is directed. More precisely, the assembly 5 is connected to the stretcher 3 by means of a support structure comprising upper flanges 70 fastened to the upper edge of a lateral beam 31 and a lower flange 71 fastened to the lower edge of that beam 31, the flanges 70, 71 being positioned in the vicinity of the rear end of the placement zone for the projectile 2, the lower flange 71 being in transverse alignment with the articulation shaft 41 of the rear connecting rod 40.

The assembly 5 shown in FIGS. 1 to 8 comprises a pair of arms 8 movable between a raised position and a lowered position, a pivoting actuation mechanism 9 for the arms 8 from the raised position to the lowered position, and return means 10 for returning the arms 8 to the raised position.

The two mobile arms 8 are configured and arranged so as to be in the plane of the lateral beam 31 in the raised position (FIGS. 4 and 7) and to come into contact with the projectile 2 in order to press it against the bottom of the stretcher 3 in the lowered position (FIG. 5). The two arms 8 are spaced apart from each other along the lateral beam 31, in other words along the longitudinal direction of the stretcher 3, and extend parallel to each other and in longitudinal alignment with each other. Each arm 8 has a concave longitudinal profile and an opposite convex longitudinal profile. The concave longitudinal profile is directed toward the inside of the stretcher 3 and the surface thereof, called bearing surface 80, is intended to cooperate with the contour of the projectile 2.

One of the longitudinal ends of each arm 8 is free and the other longitudinal end of each arm 8 is secured to a common actuating rod 11. The actuating rod 11 is a cylindrical rod mounted so as to be rotatable about a pivot axis A0 perpendicular to the longitudinal axis of each arm 8 and, in use, parallel to the longitudinal axis X0 of the stretcher 3. Preferably, the actuating rod 11 is a torsion bar.

The actuating rod 11, the longitudinal axis of which is coaxial with the pivot axis A0, is received in corresponding bores provided in the upper flanges 70. Thereby, the actuating rod 11 and thus the arms 8 are mounted so as to be able to rotate only about the pivot axis A0.

The actuating rod 11 also carries, between one of the arms 8 and the rear end thereof, the actuating member 12 of the pivoting actuation mechanism 9. The actuating member 12 is in the form of a lug having one end secured to the actuating rod 11, and hence rotatable about the pivot axis A0, and one end connected to the copy-back connecting rod 52 of said mechanism 9.

The preferred embodiment of the invention was described, which uses a pair of arms 8. However, it is possible to provide a single arm or more than two arms, e.g. two pairs arranged at a distance from each other.

The pivoting actuation mechanism 9 is mounted between the actuating rod 11 and the connecting rod 40. As can be seen more particularly in FIGS. 1 to 3, the mechanism 9 comprises, in addition to the actuating member 12, three other movable pieces connected together in an articulated manner, namely a pusher 50, a rocker 51 and a copy-back connecting rod 52.

The pusher 50 comprises a base part 50*a*, a connecting part 50*b* and a cooperation part 50*c* formed in one-piece. The base part 50*a* is in the form of a plate, e.g. of square section, and is slidably received in a pair of mating grooves formed in the lower flange 71. Thereby, the pusher 50 is mounted to move in translation with respect to the stretcher 3, along a sliding axis X1. The sliding axis X1 is orthogonal to the pivot axis A0 and lies in a plane parallel to the plane of the connecting rod 40. The connecting part 50*b* is carried by the base part 50*a* and extends from the latter and above the latter, substantially at the center thereof. The connecting part 50*b* comprises a rectilinear slot 500 opening out opposite the base part 50*a* and able to receive, in a pivoting and sliding manner, one of the shafts of the rocker 51. The cooperating part 50*c* extends from the connecting part 50*b* and toward the cam track carried by the connecting rod 40. The cooperating part 50*c* is in the form of a rod the free end of which, intended to cooperate with the cam track, is cylindrical. Thereby, the pivoting of the connecting rod 40 will cause the displacement of the cam track with respect to the cooperating part 50*c* and will push same so as to move the pusher 50 in translation along its sliding axis X1.

The rocker 51 includes three shafts 510, 511, 512 each arranged at a respective vertex of a triangle, when viewed from the side, including the shaft 510 received in the slot 500 of the pusher 50, a shaft 511 mounted to rotate in corresponding bores of the lower flange 71, and a shaft 512 articulated to the copy-back connecting rod 52. The three shafts 510, 511, 512 are parallel to each other and parallel to the pivot axis A0 of the arms 8. More particularly, the rocker 51 may have two lugs 513 facing each other and arranged on both sides of the connecting part 50*b*, these two lugs 513 being connected by the shaft 510 received in the pusher 50 and by the shaft 511 received in the flange 71. The shaft 512 articulated to the copy-back connecting rod 52 consists herein two coaxial of cylindrical pivot pins extending on either side of the two lugs 513.

The copy-back connecting rod 52 connects the rocker 51 to the actuating member 12 via a pivot connection having an axis parallel to the pivot axis A0. The pivot connection between the copy-back connecting rod 52 and the rocker 51 is defined herein by the shaft 512, namely the two coaxial cylindrical pivots which pass through the two lugs 513 of the rocker 51 and two corresponding lugs 523 at a lower end of the copy-back connecting rod 52. The pivot connection between the copy-back connecting rod 52 and the actuating member 12 is defined by a shaft 520 arranged above the shaft 512 and passing through the actuating member 12 and two corresponding lugs 521 at the upper end of the copy-back connecting rod 52.

The return means 10 for returning the arms 8 to the raised position are formed by a return spring, in particular a spiral torsion spring mounted around the actuating rod 11, one end of the spring being secured to the actuating rod 11 whereas the other end is secured to an upper flange 70. Such a spring is shown schematically in FIGS. 1 and 2. The return means 10 are arranged and configured so as to make the actuating rod 11 rotate about the pivot axis A0 in the absence of resistance at the pusher 50, resistance provided by the connecting rod 40. More particularly, the return means 10 make possible a rotation of the actuating rod 11 corresponding to an angular displacement of about 90 degrees of the pair of arms 8. Thereby, the arms 8 move from a lowered, substantially horizontal position to a raised, substantially vertical position. In the raised position, the arms 8 extend with the free end thereof directed upwards and are located outside the placement plane.

Such a mechanism 9 makes it possible to convert, reliably and simply, a rotational movement of the connecting rod 40, brought into play during the displacement of the stretcher 3 from the placement position to the ramming position, into a rotational movement of the arms 8 toward the lowered position thereof, and hence to position and keep a projectile 2 received on the stretcher 3 coaxially with the longitudinal axis X0 of the stretcher 3 before the projectile 2 is pushed toward the front of the stretcher 3.

When the stretcher 3 is in the placement position, a projectile 2 is placed in the stretcher 3. In the placement position, the cooperating part 50*c* is situated in the concave zone 42*a* of the cam track, resulting in the absence of outward push on the pusher 50, and the movable arms 8 are in the raised position, under the action of the return means 10. At the end of the placement, the projectile 2 is positioned in the stretcher 3, with the base thereof bearing against the ramming 6.

When the drive means 4 are moved in rotation, in order to move the stretcher 3 to the ramming position, the connecting rod 40 is caused to pivot, which makes the cam track cooperate with the cooperating part 50*c* of the pusher 50, as can be seen in FIGS. 6 to 8.

More particularly, during the pivoting of the connecting rod 40 from the placement position, the bulge zone 42*b* pushes the cooperating part 40*c* in the direction away from the articulation shaft 41, making the pusher 50 move in translation in the plane of the connecting rod 40 and along the axis of sliding X1, which in turn makes the rocker 51 tilt about its shaft 511, relative to the fixed lower flange 71, along a direction such that the shaft 512 for the articulation with the copy-back connecting rod 52 raises towards the stretcher 3, in other words clockwise when looking at FIG. 3. This makes the copy-back connecting rod 52 rise.

Because of the pivotal connection about the shaft 520 between the copy-back connecting rod 52 and the actuating member 12, this upward movement makes the actuating member 12 pivot about the pivot axis A0, and hence the arms 8 pivot about the pivot axis A0 toward the projectile 2, until the bearing surface 80 comes to bear against the projectile 2, which position is the lowered position of the arms 8. The bearing of the arms 8 against the projectile 2 makes it possible to press the projectile 2 against the bottom of the stretcher 3 and thus to position and keep the longitudinal axis of the projectile 2 in alignment with the longitudinal axis X0 of the stretcher 3 and centered on the positioning ring 33. Thereby, placing the arms 8 in the lowered position ensures that the projectile 2 is not off-axis before being pushed toward the front of the stretcher 3.

Upon arrival in the ramming position, the cooperating part 50*c* abuts on the flat 42*c*, the inclination of which relative to the longitudinal axis Xb of the connecting rod 40 is such that the cooperating part 50*c*, and hence the pusher 50, is allowed to move in translation along the direction bringing same closer to the articulation shaft 41, under the action of the return means 10, thereby simultaneously returning the arms 8 to the raised position thereof. The projectile 2 can then be pushed toward the front of the stretcher 3 by the pushing action of the rammer 6 on the projectile 2.

It is understood that the particular embodiment which was just described was given on an indicative and non-limiting basis, and that modifications can be made thereto without departing from the scope of present invention.

The invention claimed is:

1. A positioning and position keeping assembly for positioning and keeping in position a projectile in a stretcher, the stretcher having a longitudinal axis X0, the stretcher being movable between a first position, called placement position for the projectile and a second position, called ramming position for the projectile, using drive means which are movable, wherein the positioning and position keeping assembly comprises:

at least one arm that is movable and includes a bearing surface, the at least one arm being intended to be mounted so as to be pivotable about a pivot axis A0 orthogonal to a longitudinal direction of the at least one arm and, in use, parallel to the longitudinal X0 of the stretcher, between a raised position permitting a placement of the projectile in the stretcher, and a lowered position wherein the bearing surface is able to cooperate with the projectile received in the stretcher so as to ensure an alignment of the projectile with the longitudinal axis X0 of the stretcher, a pivoting actuation mechanism intended to cooperate with the drive means and arranged to convert a movement of the drive means during a displacement of the stretcher from the placement position to the ramming position into a pivoting of the at least one arm from the raised position to the lowered position, and elastic return means for the at least one arm so as to return same to the raised position once the stretcher has been placed in the ramming position.

2. The positioning and position keeping assembly according to claim 1, wherein it includes a pair of arms connected together by an actuating rod having a longitudinal axis which in use is coaxial with the pivot axis A0 of the at least one arm, the actuating rod being secured to the pivoting actuation mechanism and movable in rotation about the pivot axis A0 of the at least one arm, the two arms being spaced from each other along said actuating rod.

3. The positioning and position keeping assembly according to claim 2, wherein the actuating rod is a torsion bar.

4. The positioning and position keeping assembly according to claim 1, wherein the elastic return means are formed by a return spring.

5. The positioning and position keeping assembly according to claim 4, wherein the return spring is a spiral torsion spring mounted coaxially about the pivot axis A0 of the at least one arm.

6. The positioning and position keeping assembly according to claim 4, wherein the return spring is a spiral torsion spring mounted parallel to said pivot axis A0 of the at least one arm.

7. The positioning and position keeping assembly according to claim 1, wherein the pivoting actuation mechanism comprises:

a pusher intended to cooperate with the drive means and mounted to be slidable along a sliding axis X1 orthogonal to the pivot axis A0 of the at least one arm, a rocker articulated to the pusher and mounted to be pivotable about an axis orthogonal to the sliding axis X1 of the pusher and parallel to the pivot axis A0 of the at least one arm, a copy-back connecting rod articulated, by two pivot connections the axes of which are parallel, between the rocker and an actuating member, and said actuating member, which is mounted to be pivotable about the pivot axis A0 of the at least one arm and is rotationally secured to the at least one arm, the pivoting actuation mechanism being arranged in such a way that a translation of the pusher, under an action of a movement of the drive means, causes a pivoting of the rocker, which in turn causes a displacement of the copy-back connecting rod which makes the actuating member and hence the at least one arm pivot about the pivot axis A0 of the at least one arm.

8. The positioning and position keeping assembly according to claim 1, wherein the pivoting actuation mechanism is configured such that a pivoting angle of the at least one arm is 90 degrees.

9. A loading-aid device for loading a projectile into a chamber of a weapon, wherein the loading-aid device includes a stretcher for receiving the projectile and drive means for driving the stretcher and able to move the stretcher between a first position called placement position for the projectile and a second position called ramming position for the projectile, wherein the loading-aid device further includes a positioning and position keeping assembly according to claim 1, which is secured to the stretcher and is arranged on a lateral side of the stretcher with the pivot axis A0 of the at least one arm parallel to the longitudinal axis X0 of the stretcher.

10. The loading-aid device according to claim 9, wherein the drive means comprise a set of connecting rods intended to be articulated between the weapon and the stretcher about an articulation axis orthogonal to the pivot axis A0 of the at least one arm, one of the connecting rods of the set of connecting rods comprising a receiving means for receiving the rotational movement of the connecting rod and able to cooperate with the pivoting actuation mechanism of the at least one arm.

11. The loading-aid device according to claim 10, wherein the receiving means is a cam track formed on said connecting rod.

12. The loading-aid device according to claim 10, wherein the receiving means is formed on a rear connecting rod of the set of connecting rods, the pivoting actuation mechanism being positioned in a vicinity of a rear end of a projectile placement zone of the stretcher.

* * * * *